US006166724A

United States Patent [19]

Paquette et al.

[11] Patent Number: 6,166,724

[45] Date of Patent: Dec. 26, 2000

[54] METHOD AND APPARATUS FOR SEQUENCING PALETTE UPDATES IN A VIDEO GRAPHICS SYSTEM

[75] Inventors: Jeffrey D. Paquette, Raynham; Philip J. Rogers, Pepperell, both of Mass.

[73] Assignee: ATI International SRL, Christchurch, Barbados

[21] Appl. No.: 09/166,019

[22] Filed: Oct. 5, 1998

[51] Int. Cl.[7] ..... G09G 5/06

[52] U.S. Cl. ..... 345/199; 345/511; 710/22

[58] Field of Search ..... 345/199, 501, 345/507–511, 431, 186, 521, 150, 522; 710/22

[56] References Cited

U.S. PATENT DOCUMENTS 5,065,343 11/1991 Inoue ..... 395/512

5,926,155 7/1999 Arai et al. ..... 345/10

5,949,409 9/1999 Tanaka et al. ..... 345/186

*Primary Examiner*—Kee M. Tung

*Attorney, Agent, or Firm*—Markison & Reckman, P.C.

[57] ABSTRACT

A method and apparatus for sequencing palette updates in a video graphics system is accomplished by first storing a first portion of graphics data in a first position of a bus master buffer, where the first portion of the graphics data utilizes a palette. An indication of a palette update is then received, where the palette update will be used by subsequent graphics data. The updated palette is stored in a second position of the bus master buffer. A second portion of the graphics data, which utilizes the updated palette, is then stored in a third position of the bus master buffer. The data in the bus master buffer is then fetched through a direct memory access transfer initiated by the graphics processor in the system. The data is fetched in a sequential manner, which ensures that the palette update does not occur until after the graphics data utilizing the original palette has been drawn.

13 Claims, 4 Drawing Sheets

| Index # 8 bits | Red 8 bits | Green 8 bits | Blue 8 bits |
|---|---|---|---|
| 0 | 122 | 55 | 84 |
| 1 | 33 | 255 | 0 |
| 2 | 44 | 242 | 100 |
| - | - | - | - |
| - | - | - | - |
| - | - | - | - |
| 255 | 101 | 120 | 0 |

Lookup Table 36

METHOD AND APPARATUS FOR SEQUENCING PALETTE UPDATES IN A VIDEO GRAPHICS SYSTEM

FIELD OF THE INVENTION

The invention relates generally to video graphics processing and more particularly to a method and apparatus for sequencing palette updates in a video graphics system.

BACKGROUND OF THE INVENTION

Computers are used in many applications. As computing systems continue to evolve, the graphical display requirements of the systems become more demanding. This is especially true in applications where detailed graphical displays must be updated quickly. One example of such an application is a computer game where movement and modification of background images may place great demands on the processing power of the computing, system.

In order to achieve color in a video graphics system, digital values for red, green, and blue (RGB values) are provided to an analog to digital (A/D) converter which provides the analog signal that gives each pixel of the display its characteristic color. In a typical system, eight bits are used for each of the RGB colors. Thus, with eight bits required for each of the RGB colors, a total of 24 bits is required for each pixel. The various combinations of these 24 bits of RGB data allow for $2^{24}$ or nearly 17 million colors.

In order to conserve memory and improve efficiency, palettes are often created which contain a reduced number of colors that can be selected with an index that consists of a smaller number of bits. These palettes are typically implemented with a lookup table. For example, a 256-color lookup table would allow for each of the 256 colors to be selected with an eight-bit index. Each color within the lookup table would include an eight-bit value for each of the RGB colors.

Some applications utilize the color lookup table in ways that allow for flexibility in displaying images. These applications often load many different palettes into the lookup table while drawing to a single frame for display. The draw commands in the system are interspersed with changes in the palettes. In other words, a number of draw commands may be executed that use a first palette, and then a new palette may be loaded for a second set of draw commands. In order to avoid corrupting these drawing operations, the processor may be forced to wait for some of these commands to be executed by a graphics processor that is part of the system. When the processor is forced to wait for the graphics processor to complete a command or palette load, the efficiency of the system is compromised. Delays experienced by the processor translate into overall slowdowns in the execution of the program.

Consequently, a need exists for a system that allows the processor to transfer drawing commands and palette changes to the graphics processor in a faster, more efficient manner.

DETAILED DESCRIPTION OF A PREFERRED EMBODIMENT OF THE INVENTION

Figures 1, 2:
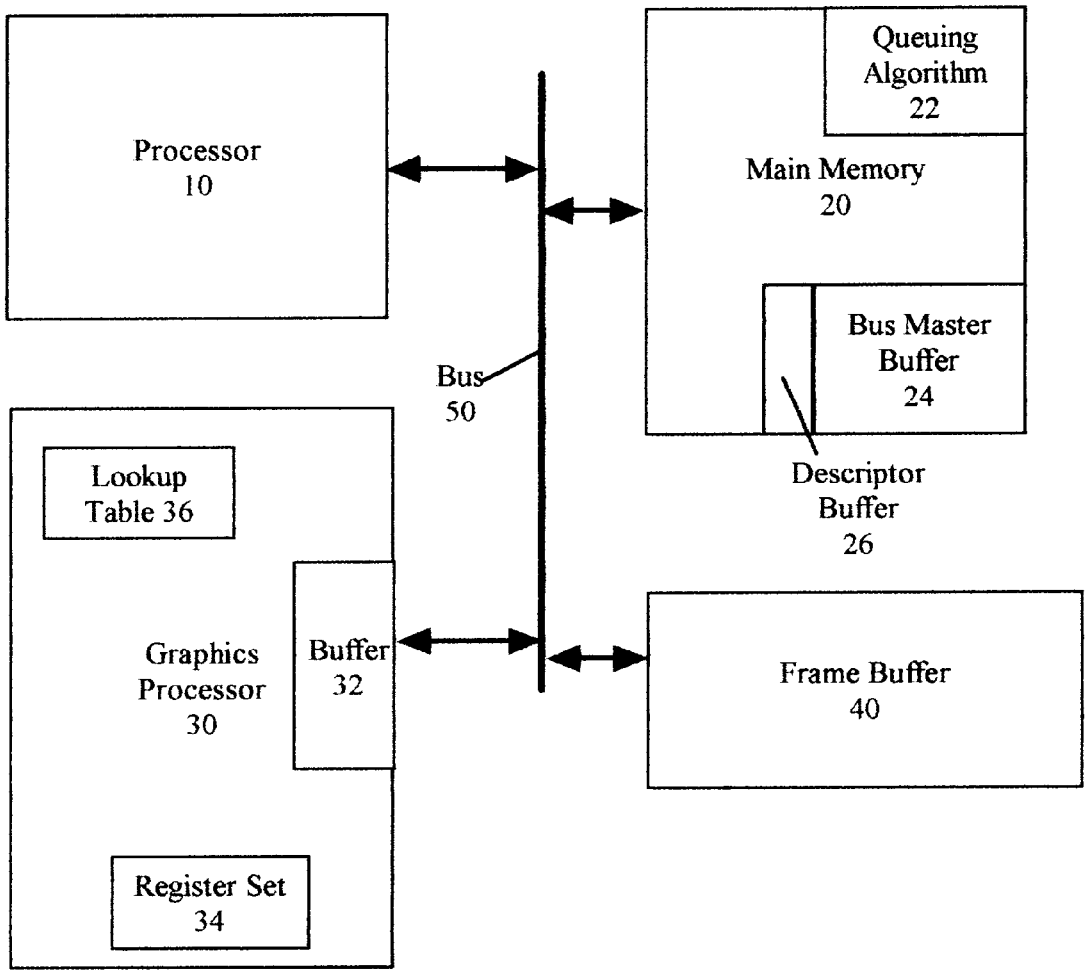
Figure 1. (PRIOR ART)
FIG. 1 illustrates a block diagram of a lookup table storing a palette.
FIG. 2 illustrates a block diagram of a video graphics system in accordance with the present invention.

Generally, the present invention provides a method and apparatus for sequencing palette updates in a video graphics system. This is accomplished by storing a first portion of graphics data in a first position of a bus master buffer, where the first portion of graphics data utilizes a palette. An indication of a palette update is then received, where the updated palette will be used by subsequent graphics data. The updated palette is stored in a second position of the bus master buffer. A second portion of graphics data, which utilizes the updated palette, is then stored in a third position of the bus master buffer. The data in the bus master buffer is fetched through a direct memory access transfer initiated by the graphics processor in the system. The data is fetched in a sequential manner, and when the drawing operations are performed, the palette update does not occur until after the graphics data utilizing the original palette has been drawn. By creating a bus master buffer which stores palette updates as well as the graphics data which utilize the palettes, the processor can store a number of sequential drawing commands in the bus master buffer and move on to perform other tasks. This offloading of the processor improves the overall speed of the video graphics system by avoiding the wait states typically encountered by processors in prior art systems.

The present invention can be better understood with reference to FIGS. 1–5. FIG. 1 illustrates a lookup table 36 that stores a plurality of colors made up of a combination of red, green, and blue (RGB) values. This set of colors is referred to as a color palette. The colors are indexed using a smaller number of bits than is required to fully describe each color. In the example illustrated, eight bits are used to index 256 possible colors. Each of the 256 colors includes an eight-bit value for each of the RGB colors. The indexed lookup table 36 allows for a much greater variety of colors to be realized using a reduced number of bits. The lookup table 36 provides a compression means for the total set of possible colors in a system. The tradeoff is that applications can only use the RGB color sets present in the lookup table at any one time, and if additional colors are desired, the palette must be updated.

Pixel data sets stored in a frame buffer can either include the precise RGB values, which require 24 bits, or they can include an eight-bit index. If the full RGB values are included, the pixel is considered a pass-through pixel, and the look up table 36 is not used for color lookup. If an eight-bit index value is included in the frame buffer, the lookup table 36 is utilized to determine the set of 24 bits making up the RGB colors for that pixel.

Some computer applications take advantage of such a lookup table to render images in various video graphics frames. These applications will often desire more than the 256 colors present in the table at one time, and therefore replace the palette in the table with a new palette. Other applications may use the lookup table 36 to store compressed texture data. In such embodiments, a single index may be used to reference multiple texels. These textures are then molded and adapted to overlay or map to structures for display. An example is a brick pattern that would be mapped onto a wall structure, where if the wall is extending into the distance, the texture will be mapped in such a way to show perspective.

Therefore, the lookup table 36 is often altered numerous times during drawing operations to a single frame, or page. For example, a first set of drawing commands may use a first compressed set of colors in the lookup table 36, and a second set of drawing commands may use another set of colors to draw to the same frame. In order to satisfy the needs of the second set of drawing commands, the data in the lookup table 36 needs to be changed when the First drawing commands are complete. This intermingling of the palette changes with drawing operations causes errors if the drawing operations are buffered in a buffer while the palette changes are executed in real time. In such a situation, the first set of drawing operations may not have time to be fetched from the buffer and executed before the palette change occurs. When this happens, the first set of drawing operations will use the updated palette resulting in corrupted images, as the palette data required by the first drawing operations has been overwritten by the palette update. The present invention eliminates this problem by buffering the palette updates in the same sequentially-accessed buffer as the drawing operations. This ensures that the palette updates occur at the correct time relative to the drawing operations.

FIG. 2 illustrates a video graphics processing system that includes processor 10, main memory 20, graphics processor 30, frame buffer 40, and bus 50 which couples the components of the system. The processor 10 may have addition connections to the main memory 20. Preferably, the graphics processor 30 and frame buffer 40 are dedicated to video graphics processing aspects of the system. The graphics processor 30 includes the lookup table 36, which can be used to store compressed color sets or textures.

The main memory 20 may include a number of memory blocks of the overall computer system including, but not limited to, random access memory (RAM), read only memory (ROM), and hard drive storage. The main memory 20 includes a bus master buffer 24 that facilitates direct memory access (DMA) transfers between the main memory 20 and the graphics processor 30. DMA transfers allow the graphics processor 30 to become the controller of the bus 50, or "bus master". When the graphics processor 30 is the bus master, it is able to perform direct memory transfers with the main memory 20. These DMA transfers are more efficient than requesting the processor 10 to perform the transfers.

Preferably, the bus master buffer 24 is made up of a number of pages, where each page includes a set of physical addresses in the main memory 20. The structure of the bus master buffer 24 can be better understood with reference to FIG. 3, which illustrates a bus master buffer 24 having N pages, where N is a number. The number of pages, N, in a particular system is based on the preferred size of the pages and the amount of memory the system allocates to the bus master buffer 24. Preferably, the bus master buffer 24 is implemented as a circular buffer such that after the Nth page 70 of the buffer 24 is accessed, the next page that is accessed will be the first page 62.

The bus master buffer 24 provides a set of pages in which data to be transferred via DMA can be stored prior to transfer. In some embodiments, DMA transfers can only be initiated by the graphics processor 30 based on physical addresses within the main memory 20. This is because virtual memory address translation is not available in DMA transfers in these systems. For this reason, the bus master buffer 24 is initially set up by requesting the desired amount of physical memory space from the processor 10. If the processor 10 denies the original memory request, smaller blocks of memory may be requested, thus reducing the number of pages in the bus master buffer 24. Preferably, the pages in the bus master buffer 24 are 4K bytes in size, and the number of pages (N) in the bus master buffer 24 is 1024. Typically, the number of pages is a power of two, which simplifies implementation of circular buffer control. It should be apparent to one skilled in the art that the page size and number of pages may be selected based on the needs of different systems.

Returning to FIG. 2, the processor 10 produces drawing commands used by the graphics processor 30. The drawing commands may utilize a palette that has been stored in the lookup table 36. If there are many drawing commands for a particular palette, the processor 10 may buffer, or queue, the commands in the bus master buffer 24. This allows the processor 10 to perform other tasks while it waits for the drawing commands to be fetched and executed by the graphics processor 30. Preferably, drawing commands are executed by storing a set of command data in a register set 34 of the graphics processor 30. In order to simplify the transfer of data to the register set 34, the data for the register set 34 may be stored sequentially in the bus master buffer 24 such that it can be transferred in a single-block DMA transfer.

In order to facilitate such register set transfers, the data to be transferred to the register set 34 may be described with a starting point, a corresponding number of registers that will be filled, and the values for the registers. This can be done using a descriptor, which is discussed below. The descriptor structure in memory allows for the block transfer of the register values and saves a great deal of processor bandwidth, as the processor 10 does not have to read and write the values to each register individually.

Thus, the processor 1I stores command data in the bus master buffer 24 that results in the drawing commands being executed. Problems in such a system can arise when the palette being used for the drawing commands is modified for subsequent drawing commands. In prior art systems, palette modifications are made directly to the lookup table 36. Queuing drawing operations can cause this direct modification of palette to corrupt the graphical display.

To illustrate, assume that the processor 10 queues a first set of drawing commands in the bus master buffer 24, where the first set of draw commands utilize a palette that is stored in the lookup table 36. If the subsequent or second set of drawing commands utilize a second palette that modified or replaced the first palette in the lookup table 36, the processor 10 would have to wait for the first set of drawing commands to complete before it could modify the palette. If the modification to the lookup table 36 were performed prior to the completion of the first set of draw commands, those drawing commands which had not yet been completed would use the second palette, which provides corrupted results.

If the processor 10 is forced to wait for the first set of draw commands to be completed, the benefits of the bus master buffer 24 may be severely diminished. The present invention provides a method for ensuring that the palette modifications of the video graphics system occur in the proper sequence with respect to the draw commands that are being executed. This is accomplished by storing new palettes in the bus master buffer 24 along with the drawing commands. The palette changes are stored in the bus master buffer 24 such that they are fetched by the graphics processor 30 after the drawing commands using previous palette have already been fetched.

The main memory 20 stores a queuing algorithm 22 which, when executed by the processor 10, causes the processor 10 to act in a predetermined manner such that it performs a specific set of functions that accomplish the proper sequencing of the drawing commands and the palette updates. First, the processor 10 queues, or stores, a first palette in the bus master buffer 24. The processor 10 then queues a palette update command in the bus master buffer 24. DMA operations by the graphics processor preferably copy palettes in the bus master buffer 24 directly into the frame buffer 40. When executed by the graphics processor 30, the palette update command causes the graphics processor 30 to copy the palette from the frame buffer 40 to the lookup table 36. After queuing the palette update command, the processor 10 queues the first drawing command that causes a first element to be drawn. The first drawing command may use the first palette. Note that many drawing commands using the first palette may be queued at this point.

Once the drawing commands using the first palette are stored, a second palette is queued in the bus master buffer 24 in a location subsequent to the first drawing command. The second palette is stored subsequent to the first drawing command. Therefore, when the graphics processor 30 performs a DMA transfer and fetches the data from the bus master buffer 24, the drawing commands associated with the first palette will be fetched and utilized prior to any use of the second palette.

The processor 10 queues a second palette update command in the bus master buffer 24 such that the second palette will be copied from the frame buffer 40 to the lookup table 36. Finally, the processor queues a second drawing command in the bus master buffer 24, where the second drawing command causes a second element to be drawn using the second palette. Because the second palette update precedes the second drawing command in the bus master buffer 24, the second palette will be in place in the lookup table 36 for use in drawing the second element. Configuring the bus master buffer 24 such that subsequent palettes can be included in the stream of data fetched by the graphics processor 31) allows the ordering of the operations performed by the graphics processor 30 to be controlled. This ensures that palette modifications and drawing commands do not occur out of order, which can result in image corruption and errors.

Once data has been stored in the bus master buffer 24, the graphics processor 3) receives an indication from the processor 10 that there is data in the bus master buffer 24 to be fetched. Palettes that are fetched by the graphics processor 30 are preferably stored in a predetermined location in the frame buffer 40 until a palette update command is fetched and executed. When a palette execute command is executed, the palette in the predetermined location of the frame buffer 40 is copied into the lookup table 36.

Once the first palette and the first palette update command have been fetched, the graphics processor 30 executes the first palette update command to copy the first palette into the lookup table 36. The first drawing command, which has also been fetched, is then executed to draw the first element using the first palette stored in the lookup table 36. Once any drawing commands that utilize the first palette have been successfully executed and the second palette and second palette update command have been fetched, the graphics processor 30 executes the second palette update command to place the second palette into the lookup table 36. The second drawing command is then executed by the graphics processor to draw the second element using the second palette stored in the lookup table 36.

Note that if a single predetermined location in the frame buffer 40 is used to store palette data, successive palettes cannot be fetched until a previous palette update to command has been executed, or the previous palette will be overwritten before it is copied to the lookup table 36. For this reason, multiple locations in the frame buffer 40 may be utilized to store palettes. In such embodiments, palette update commands must specify which palette in the frame buffer 40 is intended to be copied to the lookup table 36.

The graphics processor 30 may also include a buffer 32 that allows portions of the data fetched from the bus master buffer 24 to be stored until the graphics processor 30 is ready to process the data. This can be advantageous if it is difficult to gain bus master access to the bus 50, as a single DMA operation could transfer larger portions of data from the bus master buffer 24.

In order to better utilize the bus master buffer 24, a descriptor buffer 26 may be included in the system. The descriptor buffer 26 includes a plurality of descriptors, and each descriptor corresponds to a page in the bus master buffer 24. Because the bus master buffer 24 may require physical addresses in the main memory 20 and a sequential block of memory large enough to accommodate the entire bus master buffer 24 may not be available, the pages of the bus master buffer 24 may be scattered about the main memory 20. The descriptor buffer 26 stores the location of each of the pages of the bus master buffer 24.

Figure 3:
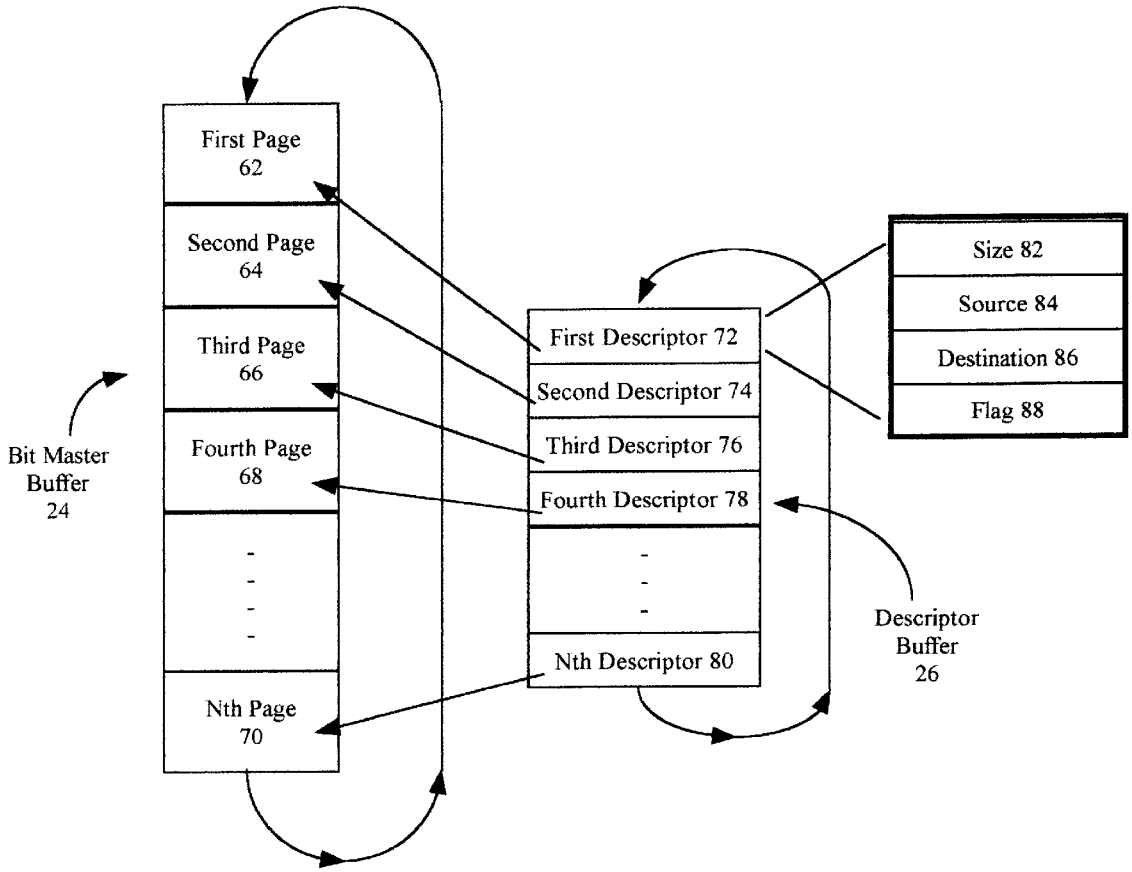
FIG. 3 illustrates a block diagram of a bus master buffer and a descriptor buffer in accordance with the present invention.

FIG. 3 illustrates the relationship between the descriptor buffer 26 and the bus master buffer 24. The descriptor buffer 26 is a circular buffer such that after the Nth descriptor 80 is accessed, the next descriptor to be accessed is the first descriptor 72. The first descriptor 72 corresponds to the first page 62 of the bus master buffer 24. Similarly, each other descriptor of the descriptor buffer 26 corresponds to one of the pages of the bus master buffer 24.

The preferred structure of a descriptor is illustrated with respect to the first descriptor 72. Preferably, a descriptor includes a size 82, a source address 84, a destination address 86, and a flag 88. The source address 84 describes the location of the corresponding bus master buffer page in memory. The destination address 86 describes the location to which the data in the corresponding page is to be transferred. The size to indicates the number of bytes of data that is to be transferred. For a command data set, the size would be based on the number of registers to be filled. For other data sets, the size of a single page may not be adequate to store the entire data set. The flag 88 is included to indicate that there is overflow to the next page of the bus master buffer 24. If the flag 88 is set, the data block to be transferred is continued in the next page of the bus master buffer 24, which is described by the subsequent descriptor.

For example, if the first page 62 stores a set of command data which draws an element, the descriptor 72 will contain a size 82 corresponding to the size of the register set 34, the source 84 will point to the first page 62 in main memory 20, and the destination 86 will point to the register set 34. The flag 88, which may be a single bit, will not be set as the command set fits within the first page 62. If the next entity stored in the bus master buffer 24 is a data block so large that it requires three pages of memory, it will be stored in the second page 64, the third page 66, and the fourth page 68. The second and third descriptors 74 and 76 will have their respective flag bits set, indicating in each case that the next descriptor contains a continuation of the data block. The fourth descriptor 78, however, will not have the flag bit set, as it points to the final page that stores a portion of the data block.

In another embodiment, the flag 88 is used to indicate that when the DMA transfer of the current page is completed, the transfer should continue and transfer the page pointed to by the following descriptor. For example, if the processor 10 stores a first set of drawing commands followed by a palette update and another set of drawing commands, all of this data may be fetched during the next DMA transfer initiated by the graphics processor 30. By fetching the data in large blocks, the graphics processor 30 does not have to repetitively perform the functions required to become the bus master, which it may have to do if it only transfers a single set of drawing commands each time it is the bus master. The processor 10 can thus partition the DMA transfer data by not setting or clearing the flag 88 at the partition points.

Figure 4:
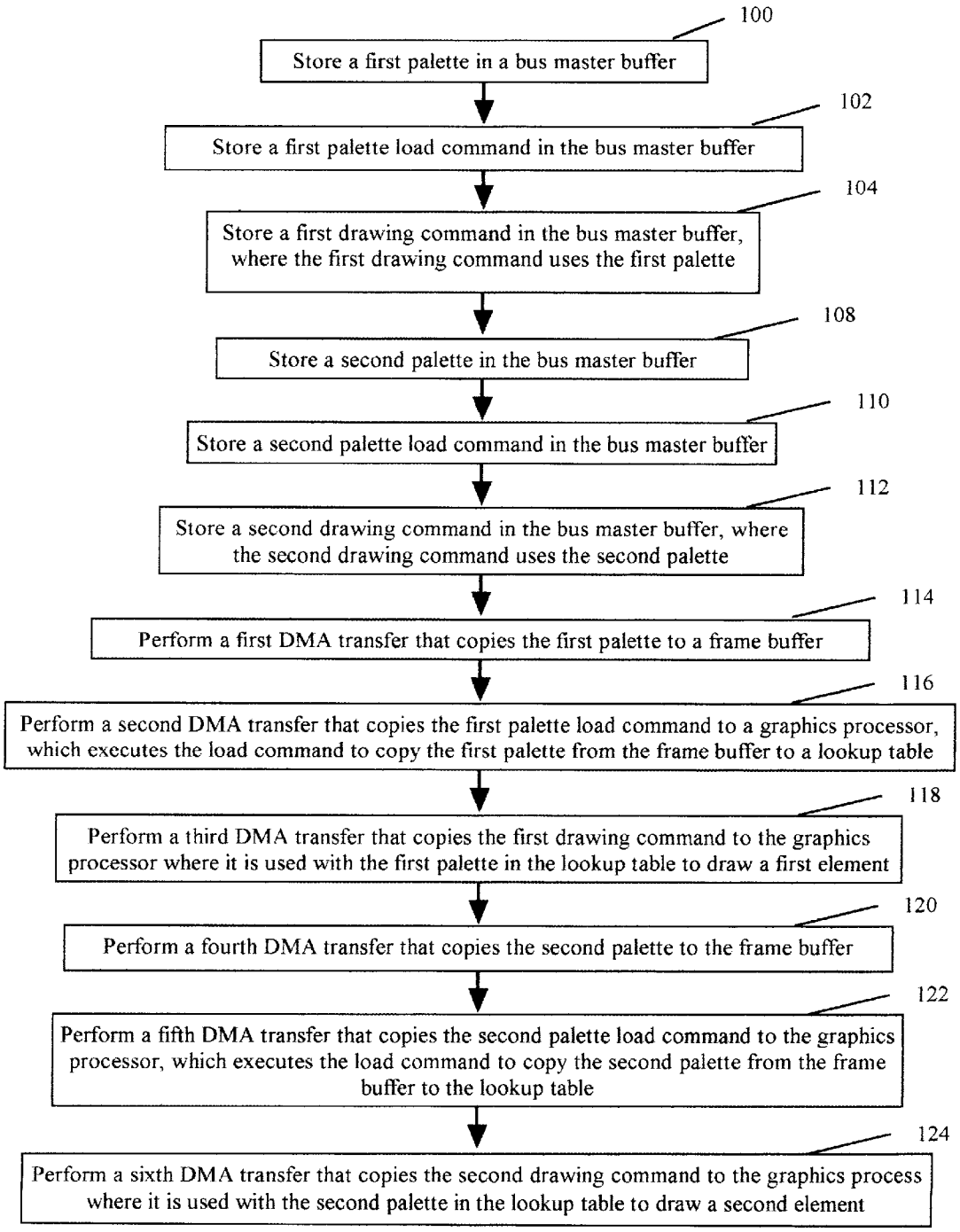
FIG. 4 illustrates a flow chart of a method for drawing to a video graphics frame using more than one palette in accordance with the present invention.

FIG. 4 illustrates a method for drawing to a video graphics frame using at least two palettes, where the method allows a processor to avoid waiting for previous operations to complete before submitting subsequent operations. At step 100, a first palette is stored in a bus master buffer in a hardware compatible format. In hardware format, no translation or conversion of the palette is required, and after it is copied into the frame buffer it can be loaded directly into a lookup table for use in the system. Preferably, the bus master buffer is similar to that described above in that it includes a number of pages and is arranged as a circular buffer. Data in the bus master buffer is fetched sequentially by a graphics processor for use in drawing the graphics stream. A set of descriptors as described with respect to FIGS. 2 and 3 may be included in the system to effectuate the fetching of the bus master buffer pages.

At step 102, a first palette load command is stored in the bus master buffer at a location subsequent to the first palette. As stated above, when the first palette load command is executed b, the graphics processor, the first palette will be loaded from the frame buffer into the lookup table. At step 104 a first drawing command is stored in the bus master buffer at a location subsequent to the first palette load command. The first drawing command utilizes the palette in drawing the primitives or shapes within that portion of the graphics stream. Note that additional pass-through portions of the graphics stream that do not utilize the lookup table can be interspersed at various points in the bus master buffer.

At step 108, a second palette in hardware format is stored in the bus master buffer at a location subsequent to the first drawing command. The second palette is different than the first palette and must replace the first palette in the lookup table before the second palette can be used by drawing commands. Therefore, if the second palette were stored directly into the lookup table of the graphics processor before the first drawing command is executed, it would corrupt the drawing of the first element.

At step 110, a second palette load command is stored in the bus master buffer at a location subsequent to the second palette. When executed, the second palette load command will load the second palette into the lookup table. At step 112, a second drawing command is stored in the bus master buffer where the second drawing command uses the second palette.

While the processor of the system is storing various commands and data in the bus master buffer, it can issue a command to the graphics processor to begin fetching the data from the bus master buffer. The processor may indicate that a fetch should occur based on the amount of data in the bus master buffer, based on a palette change, or based on other considerations that promote efficient data transfer. The indication to the graphics processor may be in the form of a direct signal to the graphics processor, or, in another embodiment, a flag may be set which is polled by the graphics processor to determine if it is time to begin fetching.

Once the graphics processor determines that fetching should occur, it commences a DMA operation to transfer the data. Fetching of the data in the bus master buffer may be performed in large or small blocks, and the size of the blocks transferred may be based on the time allotted to the graphics processor as bus master or the type of commands and data transferred. Thus, the DMA transfers of steps 114–124 may occur individually or in groups of varying size.

At step 114, a first DMA transfer copies the first palette to a first palette location in the frame buffer of the system. The frame buffer of the system is used to store graphical data for display and other data for use by the graphics processor. At step 116 a second DMA transfer copies the first palette load command from the bus master buffer to the graphics processor. The graphics processor executes the first palette load command, which causes the graphics processor to copy the first palette from the frame buffer to the lookup table in the graphics processor.

At step 118, a third DMA transfer copies the first drawing command from the bus master buffer to the graphics processor. Preferably, the first drawing command is copied from the bus master buffer to a set of registers in the graphics processor in a single block transfer. The graphics processor executes the first drawing command to draw a first element using the first palette, which is stored in the lookup table. Additional drawing commands that utilize the first palette may be transferred and executed at this time, as may pass through drawing commands that do not require the lookup table.

At step 120, a fourth DMA transfer copies a second palette from the bus master buffer to the frame buffer. Assuming that the graphics processor has already fetched the first palette and the first palette load command, the location in the frame buffer in which the first palette was stored may be reused to store the second palette.

At step 122, a fifth DMA transfer copies the second palette load command from the bus master buffer to the graphics processor. The second palette load command is executed by the graphics processor, causing the graphics processor to copy the second palette from the frame buffer to the lookup table. Copying the second palette to the lookup table overwrites the first palette. Because the fetches from the bus master buffer are sequential, the loading of the second palette does not occur until after the drawing commands utilizing the first palette have completed. This allows the processor of the system to offload drawing operations, including palette changes. The offloading allows the processor to perform other tasks that improve the efficiency and speed of the overall system.

Finally, at step 124, a sixth DMA transfer copies the second drawing command from the bus master buffer to the graphics processor. The second drawing command utilizes the second palette to draw a second element. At this point, additional palettes and drawing commands may be fetched based on the drawing needs of the system. If a predetermined number of palettes are used repeatedly in the system, these palettes can be stored in the frame buffer and loaded repeatedly based on palette load commands issued by the processor. Reusing a fixed set of palettes avoids the requirement of continuously copying palettes from the bus master buffer to the frame buffer.

The method of FIG. 4 provides another example of the queuing technique that can be used to ensure that palettes are not changed, or corrupted, before their use is completed. By queuing the operations using the palettes in the same queue as the palettes themselves, problems with ordering of the operations with respect to palette changes are avoided. The queuing, or buffering, allows the processor in the system to store a number of video graphics operations or commands in the bus master buffer and then perform other tasks without having to wait or monitor the progress of the graphics processor.

Figure 5:
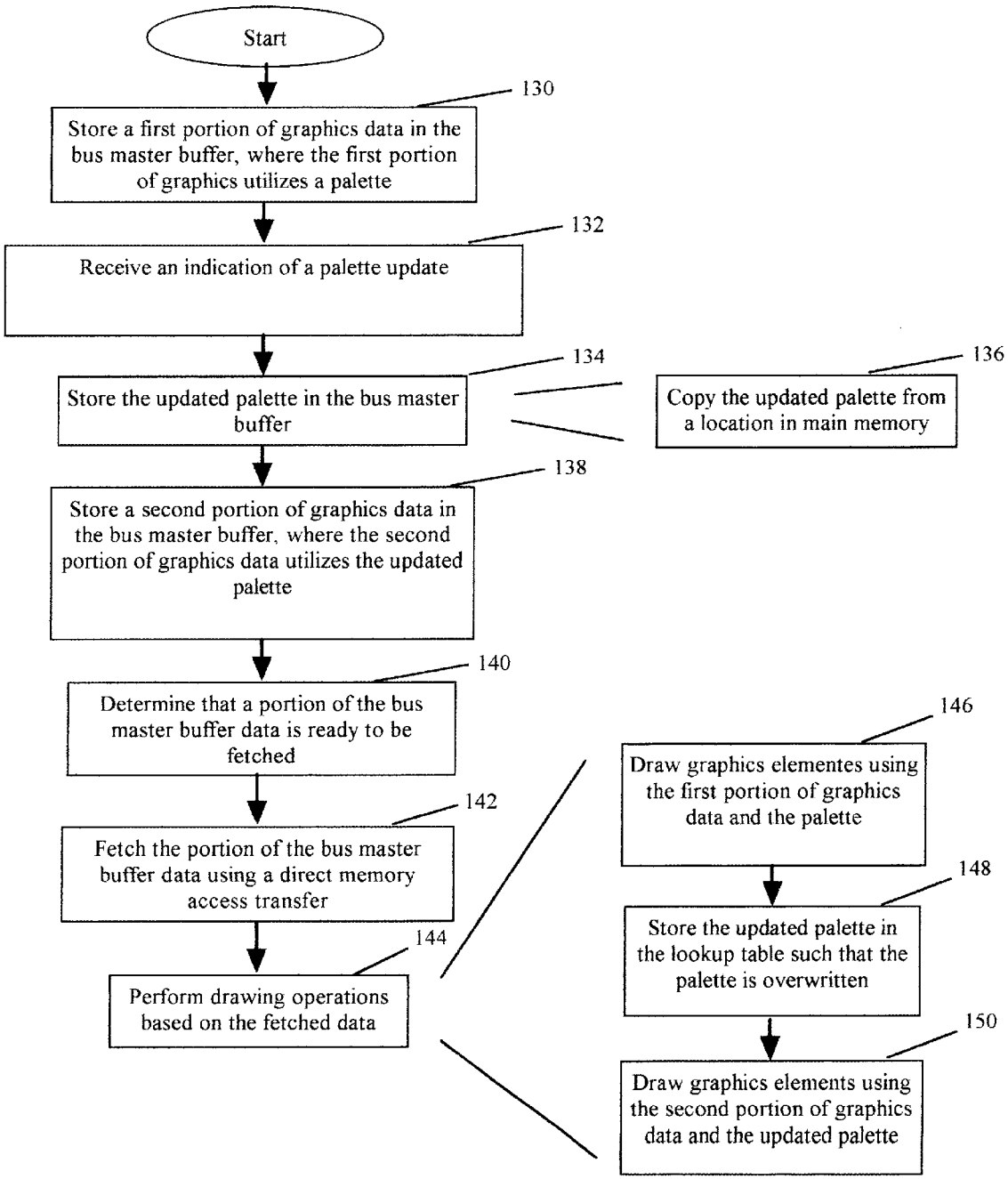
FIG. 5 illustrates a flow chart of a method for sequencing a palette update in a video graphics system in accordance with the present invention.

FIG. 5 illustrates a method for sequencing a palette update in a video graphics system. At step 130, a first portion of graphics data is stored in a bus master buffer, where the first portion of graphics data utilizes a palette. Preferably, the palette has already been loaded into the lookup table of the graphics processor in the system. When the graphics processor receives the first portion of graphics data, it can process the data along with the palette stored in the lookup table to produce the graphical images the graphics data describes.

At step 132, an indication of a palette update is received. The palette update, when executed, will modify the palette currently stored in the lookup table. As before, if the palette update occurs before the first portion of graphics data has been fully processed, the results will be erroneous and undesirable. Therefore, the palette update must be delayed in order to ensure that this does not occur.

The optimal solution is to delay the palette update just until the graphics processor has processed the first portion of graphics data. The first portion of graphics data is stored in the bus master buffer and will not be processed until after it has been fetched. Based on this, a near optimal solution is achieved at step 134 when the updated palette is stored in the portion of the bus master buffer that will be fetched after the portion containing the first portion of graphics data.

Preferably, at step 136, the updated palette is stored in the bus master buffer by copying the updated palette from a location in the memory of the system to the bus master buffer. When the palette has been copied, the processor can be notified that the palette modification has taken place. This allows the processor to reuse the portion of memory from which the updated palette was copied. As described above, the bus master buffer may be constructed of a plurality of pages, and if a data set requires a number of pages, a flag can be set in all but the last page to indicate that the data set is continued on the immediately following page.

At step 138, a second portion of graphics data is stored in the bus master buffer, where the second portion of graphics data utilizes the updated palette. When the graphics processor fetches the second portion of graphics data and attempts to use the data, proper use of the data requires that the updated data set be present in the lookup table. Because the updated palette precedes the second portion of graphics data in the bus master buffer, the updated palette will be fetched and stored before the second portion graphics data is processed.

At step 140, it is determined that a portion of the bus master buffer data is ready to be fetched. This determination may be based on polling a flag or descriptors describing the bus master buffer or by receiving a signal from the processor. At step 142. data in the bus master buffer is fetched in a sequential manner to produce fetched data. The amount of data fetched may be all of the data ready to be fetched or it may be only a portion of such data. The fetching is accomplished through a DMA transfer initiated by the graphics processor.

At step 144, drawing operations are performed based on the fetched data such that the first portion of graphics data is acted upon before the palette update is performed. Preferably, the drawing operations follow the method illustrated in steps 146–150. At step 146, graphics elements are drawn using the first portion of the graphics data and the palette. This occurs before the palette update is performed. At step 148, the updated palette is stored in the lookup table such that the original palette in the lookup table is overwritten. Finally, at step 150, the graphics elements using the second portion of the graphics data and the updated palette are drawn. Note that the first portion of graphics data can be fetched before the updated palette is stored in the bus master buffer, and the only requirement is that the data in the bus master buffer is accessed or fetched sequentially. This ensures that the palette updates occur in the proper timeframe with respect to the processing of the graphics data that makes use of the palettes.

The present invention provides a method and apparatus for sequencing palette updates in a video graphics system. By intermingling the palette updates with the data that utilizes the palettes in a buffered system, the ordering of operations is not altered while still allowing the system processor to be offloaded. The buffering allows for data to be transferred to a graphics processor via a DMA transfer, which allows registers and palettes to be updated and stored more rapidly than through conventional read/write transfers of data. By using the method and apparatus herein, the speed of systems using graphical processors for graphical displays can be increased without inducing errors or aberrations.

Software algorithms that cause a processor or controller to perform the functions of the methods illustrated herein may be stored in any manner of computer readable medium, including- but not limited to a diskette, magnetic tape, ROM, RAM, a hard disk, or a CD-ROM. Execution of the software by a processor will cause the processor to operate in a specific and predetermined manner such that it performs the steps or functions required by the methods described above. In some embodiments, circuitry or hardware may perform some or all of the steps or functions, whereas other steps or functions are performed in software.

It should be understood that the implementation of other variations and modifications of the invention in its various aspects will be apparent to those of ordinary skill in the art, and that the invention is not limited by the specific embodiments described. For example, the bus master buffer may be implemented in a separate distinct memory apart from the main memory of the system such that the descriptors can be incorporated into the sequential pages of the bus master buffer. It is therefore contemplated to cover by the present invention, any and all modifications, variations, or equivalents that fall within the spirit and scope of the basic underlying principles disclosed and claimed herein.

What is claimed is:

1. A method for drawing to a video-graphics frame using at least two palettes, the method comprising:

storing a first palette in a bus master buffer, wherein the first palette is stored in a hardware compatible format;

storing a first palette load command in the bus master buffer at a location subsequent to the first palette;

storing a first drawing command in the bus master buffer at a location subsequent to the first palette load command, wherein the first drawing command utilizes the first palette;

storing a second palette in the bus master buffer, wherein the second palette is stored in a hardware compatible format at a location subsequent to the first drawing command;

storing a second palette load command in the bus master buffer at a location subsequent to the second palette;

storing a second drawing command in the bus master buffer at a location subsequent to the second palette load command, wherein the second drawing command utilizes the second palette; and performing a first direct memory access data transfer, wherein the first direct memory access data transfer copies the first palette to a first palette location in a frame buffer;

performing a second direct memory access data transfer, wherein the second direct memory access data transfer copies the first palette load command to a graphics processor, wherein when executed by the graphics processor, the first palette load command copies the first palette from the frame buffer to a lookup table;

performing a third direct memory access data transfer, wherein the third direct memory access data transfer copies the first drawing command to the graphics processor, wherein the graphics processor executes the first drawing command to draw a first element to the video-graphics frame using the first palette in the lookup table;

performing a fourth direct memory access data transfer, wherein the fourth direct memory access data transfer copies the second palette to a second palette location in the frame buffer;

performing a fifth direct memory access data transfer, wherein the fifth direct memory access data transfer copies the second palette load command to the graphics processor, wherein when, executed by the graphics processor, the second palette load command copies the second transferred palette from the frame buffer to the lookup table, wherein copying the second palette overwrites the first palette in the lookup table; and performing a sixth direct memory access data transfer, wherein the sixth direct memory access data transfer copies the second drawing command to the graphics processor, wherein the graphics processor executes the second drawing command to draw a second element to the video-graphics frame using the second palette in the lookup table.

2. The method of claim 1, wherein performing the fourth direct memory access data transfer further comprises copying the second palette to the second palette location in the frame buffer, wherein the second location in the frame buffer matches the first location in the frame buffer such that the first transferred palette is overwritten in the frame buffer.

3. A method for sequencing a palette update in a video graphics system comprising:

storing a first portion of graphics data in a first position of a bus master buffer, wherein the first portion of graphics data utilizes a palette;

receiving an indication of a palette update, wherein an updated palette resulting from the palette update is to be used with subsequent graphics data;

storing the updated palette in a second position of the bus master buffer;

storing a second portion of graphics data in a third position of the bus master buffer, wherein the second portion of graphics data utilizes the updated palette; and determining when a portion of data in the bus master buffer is ready to be fetched by a graphics processor, and fetching the portion of the data in the bus master buffer to produce fetched data, wherein fetching is performed using a direct memory access transfer initiated by the graphics processor, wherein fetching fetches data from the bus master buffer in a sequential manner; and performing drawing operations based on the fetched data such that the first portion of graphics data is utilized before the palette update is performed.

4. The method of claim 3, wherein performing drawing operations further comprises:

drawing graphics elements using the first portion of graphics data and the palette, wherein the palette is stored in a lookup table;

storing the updated palette in the lookup table such that the updated palette overwrites the palette; and drawing graphics elements using the second portion of graphics data and the updated palette stored in the lookup table.

5. The method of claim 4, wherein fetching the portion of the data further comprises copying the updated palette to a frame buffer, and wherein storing the updated palette in the lookup table further comprises copying the updated palette from the frame buffer to the lookup table.

6. The method of claim 5, wherein storing the updated palette in the bus master buffer further comprises copying the updated palette from a location in main memory.

7. A video graphics processing system comprising:

a bus;

a memory operably coupled to the bus, wherein the memory includes a bus master buffer and stores a queuing algorithm;

a processor operably coupled to the bus, wherein the processor executes the queuing algorithm such that it causes the processor to operate in a specific and predetermined manner to perform the functions of:

queuing a first palette in the bus master buffer;

queuing a first palette update command in the bus master buffer;

queuing a first drawing command in the bus master buffer;

queuing a second palette in the bus master buffer;

queuing a second palette update command in the bus master buffer;

queuing a second drawing command in the bus master buffer;

a frame buffer operably coupled to the bus, wherein the frame buffer stores graphics data including at least one palette; and a graphics processor operably coupled to the bus, wherein the graphics processor includes a lookup table, wherein the graphics processor fetches queued data from the bus master buffer using direct memory access transfers, wherein the graphics processor:

executes the first palette update command such that the first palette is copied to the lookup table;

executes the first drawing command to draw the first element using the first palette stored in the lookup table;

executes the second palette update command such that the second palette is copied to the lookup table, wherein the second palette overwrites the first palette in the lookup table;

executes the second drawing command to draw the second element using the second palette stored in the lookup table.

8. The video graphics processing system of claim 7, wherein the graphics processor initially stores fetched palettes in the frame buffer, wherein when the graphics processor executes the first palette update command, the graphics processor copies the first palette from the frame buffer to the lookup table, and wherein when the graphics processor executes the second palette update command, the graphics processor copies the second palette from the frame buffer to the lookup table.

9. The apparatus of claim 8, wherein the first and second palettes store compressed texture data.

10. The apparatus of claim 9, wherein the bus master buffer includes a plurality of bus master pages, wherein palettes and command data are stored in the bus master pages.

11. The apparatus of claim 10 further includes a descriptor buffer that includes a plurality of descriptors, wherein each descriptor of the descriptor buffer corresponds to a bus master page, and wherein each descriptor of the plurality of descriptors stores a size value, an origination location, and a destination location for a corresponding bus master page.

12. The apparatus of claim 10, wherein the graphics processor includes a buffer wherein the graphics processor stores a portion of fetched queued data in the buffer while performing operations using a preceding portion of the fetched queued data.

13. The apparatus of claim 10, wherein the graphics processor includes a set of registers, wherein fetched command data is stored in the registers.

* * * * *